US007784233B2

(12) United States Patent
Friedlich

(10) Patent No.: US 7,784,233 B2
(45) Date of Patent: Aug. 31, 2010

(54) MOLDING ASSEMBLY, MODULAR MOLDING SYSTEM, AND METHODS FOR USING THE SAME

(76) Inventor: William Friedlich, c/o Hudson View Construction Inc., 396 W. 255th St., Riverdale Bronx, NY (US) 10471

( * ) Notice: Subject to any disclaimer, the term of this patent is extended or adjusted under 35 U.S.C. 154(b) by 935 days.

(21) Appl. No.: 11/270,921

(22) Filed: Nov. 12, 2005

(65) Prior Publication Data

US 2007/0107342 A1 May 17, 2007

(51) Int. Cl.
*E04B 2/00* (2006.01)

(52) U.S. Cl. ..... 52/287.1; 52/718.01

(58) Field of Classification Search ..... 52/287.1, 52/288.1, 290, 718.01, 717.05
See application file for complete search history.

(56) References Cited

U.S. PATENT DOCUMENTS

| | | | | |
|---|---|---|---|---|
| 2,007,244 | A * | 7/1935 | Gathercoal | 52/288.1 |
| 4,642,957 | A | 2/1987 | Edwards | |
| 4,708,894 | A | 11/1987 | Mabuchi et al. | |
| 5,179,811 | A * | 1/1993 | Walker et al. | 52/288.1 |
| 5,199,237 | A * | 4/1993 | Juntunen | 52/287.1 |
| 5,555,687 | A | 9/1996 | Logan et al. | |
| 5,555,688 | A | 9/1996 | Logan | |
| 5,592,797 | A | 1/1997 | Logan et al. | |
| 5,705,002 | A | 1/1998 | Sherry | |
| 5,802,790 | A * | 9/1998 | Lamont et al. | 52/288.1 |
| 5,809,718 | A | 9/1998 | Wicks | |
| 5,819,485 | A | 10/1998 | Lane et al. | |
| 5,953,881 | A | 9/1999 | Sherry | |
| 6,173,542 | B1 | 1/2001 | Wright | |
| 6,253,510 | B1 | 7/2001 | Santarossa | |
| 6,276,101 | B1 | 8/2001 | Schiedegger et al. | |
| 6,381,915 | B1 | 5/2002 | Wood | |
| 6,385,927 | B2 | 5/2002 | Schiedegger et al. | |
| 6,463,707 | B1 | 10/2002 | Schiedegger et al. | |
| 6,477,818 | B1 | 11/2002 | Jensen | |
| 6,481,170 | B1 | 11/2002 | Savenok et al. | |
| 6,918,977 | B1 * | 7/2005 | Maurer | 156/71 |
| 2001/0032423 | A1 | 10/2001 | Schiedegger et al. | |
| 2002/0112423 | A1 | 8/2002 | Schiedegger et al. | |
| 2003/0014931 | A1 | 1/2003 | Hahn | |
| 2004/0065031 | A1 * | 4/2004 | Steinberg et al. | 52/287.1 |
| 2007/0017174 | A1 * | 1/2007 | Lavell | 52/267 |

* cited by examiner

*Primary Examiner*—Brian E Glessner
*Assistant Examiner*—Adriana Figueroa
(74) *Attorney, Agent, or Firm*—Lackenbach Siegle, LLP; Myron Greenspan

(57) ABSTRACT

There is provided at least one molding segment in a modular molding kit or system. The molding segment comprises a rearward attachment and an alignment surface that define an angle there between. Placing the rearward attachment side against a wall and placing the alignment surface proximate to a ceiling thereby forms an alignment gap between the alignment surface and the ceiling. The molding segment optionally includes an alignment wedge, and possibly a compressible lip, to cover the alignment gap to adapt to non-planar surfaces and thereby produce the appearance of a unitary molding piece that is mounted flush to both the wall and the adjacent ceiling. One embodiment further includes an integrated covering segment extending from and conjoined to a side edge of a forward decorative surface. The integrated covering segment is adapted to cover a seam formed between the forward decorative surface and a second molding piece mounted adjacent to the forward decorative surface.

39 Claims, 13 Drawing Sheets

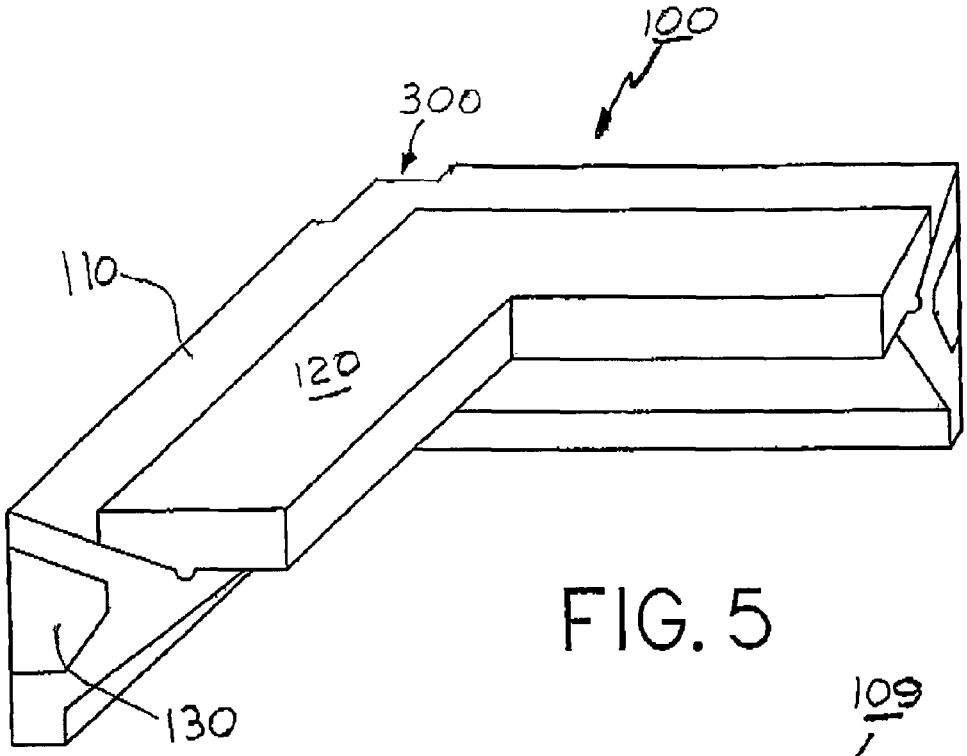
FIG. 5
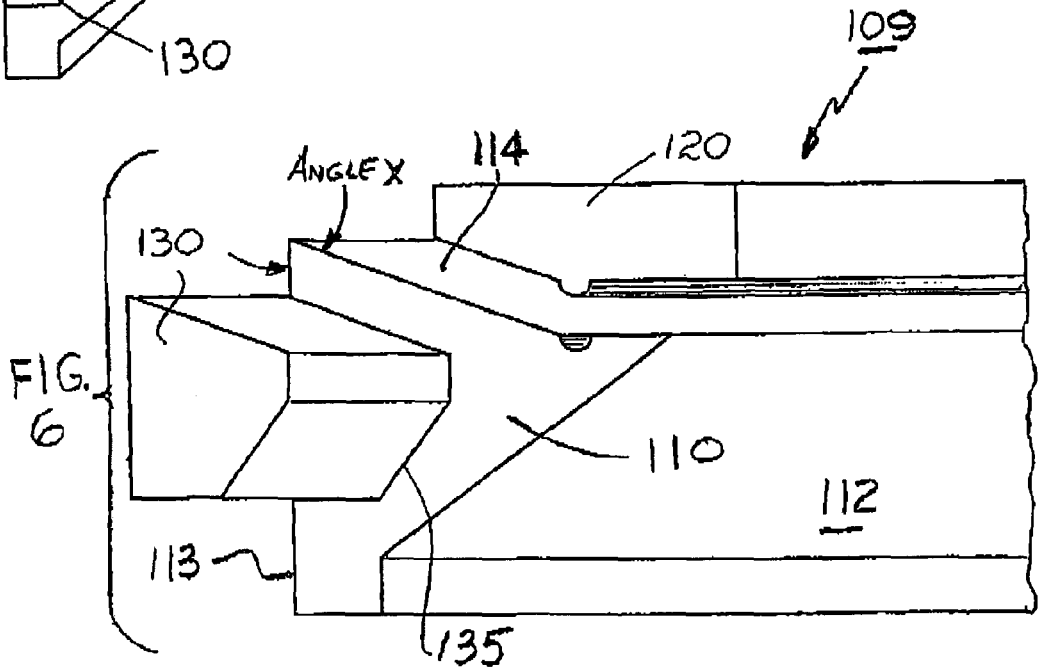

50
52
52a
511a
22
52b
511b
51
24

70
70
711
71

X
X
17b
17
17b

17
X
17a
X

MOLDING ASSEMBLY, MODULAR MOLDING SYSTEM, AND METHODS FOR USING THE SAME

BACKGROUND OF THE INVENTION

1. Field of the Invention

This invention is related to components of building structures. In particular, this invention relates to structures wherein a trim-type element, i.e., a piece of a modular system, is generally attached at a wall-ceiling intersection and serves as a covering strip, especially for decorative purposes.

2. Description of the Prior Art

Interior decorative molding, such as crown molding, door and window casings, chair rails, baseboards, etc., are commonly used in the construction industry. Crown moldings, in particular, are commonly used to decorate a room by providing a decorative transition between a vertical wall and a ceiling.

Molding typically has a single decorative side, and a flat side that is mounted on a wall, ceiling, or floor surface. The visually appealing decorative surface is usually formed in three dimensions with the molding often having a uniform cross-sectional profile. A uniform cross-sectional profile is the simplest molding to manufacture, either of wood by milling the decorative surfaces, or in the case of extruded plastic molding, by extruding through a uniform profile die.

Typically, moldings are made of wood. However, the costs for wood moldings are ever-increasing due to the labor intensive nature of the milling process and the gradual depletion of suitable forest wood stocks. For example, wood used to manufacture molding must usually be clear of knots and of suitable consistency to produce a smooth finish surface. The high costs associated with manufacturing wood molding make wood molding cost prohibitive. As such, efforts have been made to develop moldings that can be economically manufactured. Therefore, although wood moldings are the most common type of moldings, other less expensive alternatives are becoming popular.

An alternative to wood molding is plastic molding, which is typically manufactured via extrusion, and may be solid or formed with a solid skin surrounding a foam core. Unfortunately, plastic molding has its own problems and associated costs. In general, plastic molding is not preferred over wood molding because it is difficult to properly finish joints between adjacent plastic molding pieces. Also, potentially toxic fumes may be produced if the plastic molding is burned. In fact, there are very few comparative cost advantages in using plastic moldings from an environmental-impact perspective. However, plastic moldings have uniform cross-sections and may be cost effective for larger uses.

Another alternative to wood molding is plaster molding, which is regaining its popularity despite it extremely high cost. During Victorian times relatively large crown moldings for example, were fairly common in homes or public buildings. Using plaster, complex shapes can be produced with relative ease, and plaster has an improved fire-safety compared to both wood and plastic. Today, nostalgia and the desire for a custom profile is often the driving force for using plaster molding.

One way to produce plaster molding is by casting; namely using a rubber mold (usually four to six feet or 1.2 to 1.8 meters in length) filled with a liquid plaster mixture. The solidified plaster is later removed from the mould and installed as needed. Plaster molding is installed on site and usually painted to match the color of the adjacent wall and/or ceiling. Unfortunately, plaster molding suffers from breakage during manufacture, handling, and installation. Plaster molding also chips easily. Moreover, a fairly high degree of skill and experience is required to both produce the rubber molds and install the molding correctly. To provide additional strength and to resist cracking, the plaster mixture in older construction methods would be combined with horsehair, rope fibers or other natural fibers as reinforcement. Modern plastic fibers or fiberglass, Teflon®, etc., can also be added to the plaster mixture for reinforcement. An alternative to plaster molding casting, is to form the plaster in place using a series of separate passes to build up a plaster profile on a wooden support structure.

As noted above, molding, such as crown molding has conventionally been custom-cut and installed by skilled craftsmen because the installation of molding is very labor intensive and time consuming, especially for traditional, common wood molding. For example, wood molding must be properly and exactingly measured for the location it is to be used. Specifically, in each corner of the room, the molding segments must be precisely cut to form mitered and/or coped joints.

Mitering and coping are techniques requiring for proper installation, and are typically possessed by those skilled in the finish carpentry trade. Mitering and coping typically require expensive and/or potentially dangerous tools, such as a compound miter saw, which should only be operated by experienced crafts-persons. It is also worth noting that cutting wood molding creates significant amounts of sawdust, which adds to the inconvenience associated with installation and also can be a health hazard, depending upon the wood species. Even where corner blocks are used instead of mitered joints, the molding pieces must be cut to precise and accurate lengths, which still require finish carpentry skills. With the increasing cost of skilled labor, and the increasing interest of homeowners in do-it-yourself home renovation projects, it has become desirable to provide a means for relatively unskilled persons working alone with a minimum of tools to easily install and maintain attractive moldings in the home.

One of the main problems for the do-it-yourselfer in the installation of moldings is the need for precise measurement of components to avoid gaps or overlaps during installation. Another is the need for skill in cutting or sawing components to produce true and correctly angled cuts for professional-looking joints and miters. As an example, often installing expensive crown molding between opposing walls requires a desirable "spring" or making the cut piece slightly (⅛") long, so that the molding ends and joints are placed in compression during installation and more easily concealed. As a second example, a non-standard miter-cut (angled cut) may be necessary to compensate for a non-perpendicular ceiling-wall interface. In both instances, it is desirable to produce true and correctly angled cuts.

A third problem is the fact that do-it-yourselfers frequently work alone at odd hours and are unable to call upon others to assist in supporting and aligning molding components during installation. This problem is magnified where high ceilings (10-14') exist, or where stairs and landings are involved.

Unfortunately, despite the improvements of economy and efficiency of installation provided by composite moldings, current designs are still hampered by a multitude of components which must be interconnected together in various forms to form a length to cover a wall and/or a corner section. The multitude of required different pieces also significantly adds to the cost of production. Accordingly, what is desirable, and has not heretofore been developed, is a modular molding system that has the desired benefits of economy and ease of installation, with the added advantages of simplicity of design and construction.

Perhaps the most difficult aspect of installing molding is an aspect that the installer has no control over, namely whether or not the walls, ceiling, and floor are straight and level. The best quality molding installed by the most experienced craftsperson would still appear shoddy if uneven walls resulted in gaps between the molding and the ceiling or floor. Uneven walls, ceiling, and floors are an especially common problem when trimming-out older houses. If the gaps are fairly small, say less than about ⅜" (about 9.5 mm), the gaps may be filled with acrylic or other flexible caulk. If the gaps are larger than ⅜", the walls themselves may need to be repaired.

Another difficulty often encountered during molding installation involves the differing finishes applied to walls, ceilings, floors, and other surfaces. For example, walls are frequently covered with wallpaper, ceilings with paint or a pebbled-stucco-type finish, and floors with either carpet or a smooth varnish. Ideally, the installation and finishing of molding avoids damage to the differing finish surfaces involved. Current molding systems are incapable of uniformly dealing with all surface finishes without adaptive effort.

A final difficulty with conventional molding and conventional installation techniques involves locating the underlying wall and ceiling studs. Today, typical stud spacing is 16" on center (16 O.C.). This spacing uniformity aids installation because once a single stud is located, sequential location is simple. Unfortunately, previous construction techniques (prior to about the 1950's) employed irregular and unpredictable spacing making stud location more of an art than a science. Since it is often desirable to position a conventional molding joint on a stud (allowing both pieces to be joined to the same stud) locating stud position is important to proper installation.

Attempts have been made to counter at least some of the detriments found within conventional molding installation practice as described.

U.S. Pat. No. 5,199,237, which issued on Apr. 6, 1993 to Juntunen, provides a Miterless Molding System. In particular, the system includes a decorative receptacle covering and provides that appearance of a finished joint between adjacent rough cut ends of two lineal moldings.

U.S. Pat. No. 5,809,718, which issued on Sep. 22, 1998 to Wicks, provides a Modular Molding System. The modular molding system of Wicks uses slotted blocks that are first individually mounted on a support surface (i.e., the wall-ceiling interface). Lengths of molding runner are inserted into the slots of the blocks.

U.S. Pat. No. 6,253,510, which issued on Jul. 3, 2001 to Santarossa, provides a Lightweight Interior Molding. This invention is a lightweight gypsum-coated decorative molding that is flexible enough to withstand minor handling without cracking.

U.S. Pat. No. 6,477,818, which issued on Nov. 12, 2002 to Jensen, provides a Modular Molding System. The modular molding system of Jensen comprises a plurality of modular molding sections that include an angled face portion and a horizontal alignment portion. One end of each molding section is angled, while the other end is straight. The molding sections are flexible to abut to an uneven surface of a vertical wall. The horizontal alignment portion has a dual purpose of carrying an adhesive, as well as providing means for insuring that the molding section is properly spaced from the vertical wall.

Unfortunately, none of the previous efforts in this area, taken either alone or in combination, teach or suggest the features and benefits of the present invention.

SUMMARY OF THE INVENTION

In accordance with the above objects, and others that will be discussed in the course of the disclosure of the present invention, there is provided, in one embodiment, a molding segment for a modular molding system.

In one of the present embodiments, a molding segment comprises a rearward attachment and an alignment surface that generally define an acute internal angle there between. Placing the rearward attachment side against a wall and placing the alignment surface adjacent to another surface (for example a ceiling) thereby forms an alignment gap between the alignment surface and the adjacent surface.

The molding segment further comprises an alignment wedge or compressible lip or means to cover the alignment gap to thereby produce the appearance of a unitary molding piece that is mounted flush to both the wall and the adjacent ceiling. In one preferred embodiment, the molding segment further comprises an integrated covering segment conjoined to a side edge of a forward decorative surface. The integrated covering segment is adapted to cover a seam formed between the forward decorative surface and a second molding piece mounted adjacent to the forward decorative surface.

BRIEF DESCRIPTION OF THE DRAWINGS

The above and other objects of the invention may be more readily seen when viewed in conjunction with the accompanying drawings, wherein:

FIG. 5 is a perspective view of a molding corner piece assembly for one embodiment of the modular molding system according to the present invention.

FIG. 6 is a partially exploded side view of the molding corner assembly of FIG. 5, illustrating the engagement of the molding corner piece and the alignment wedge according to the present invention.

DESCRIPTION OF THE INVENTION

Figure 1:
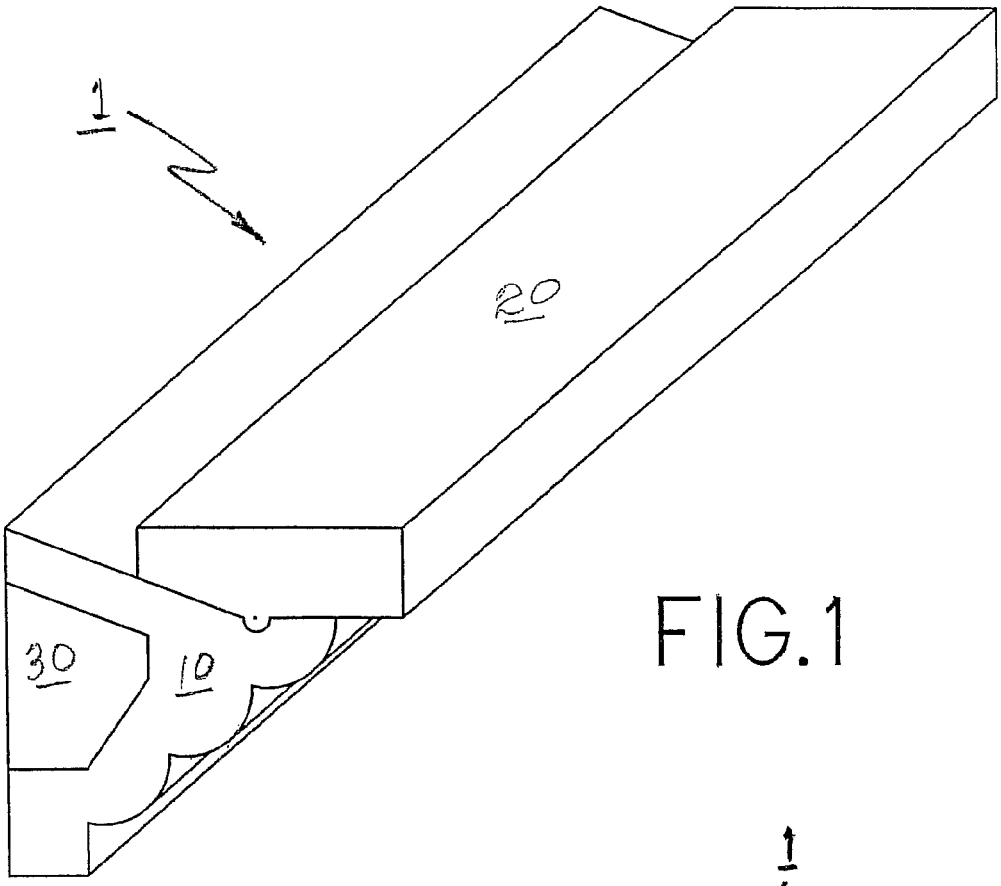
FIG. 1 is a perspective side view of a molding runner assembly for a modular molding system according to one embodiment of the present invention.

Referring to the figures, and FIG. 1 in particular, there is illustrated a molding runner assembly 1, for a modular molding system according to the present invention. Molding runner assembly 1 includes at least a molding runner piece 10, and preferably comprises an alignment wedge 20 and a removable block 30.

Figure 2:
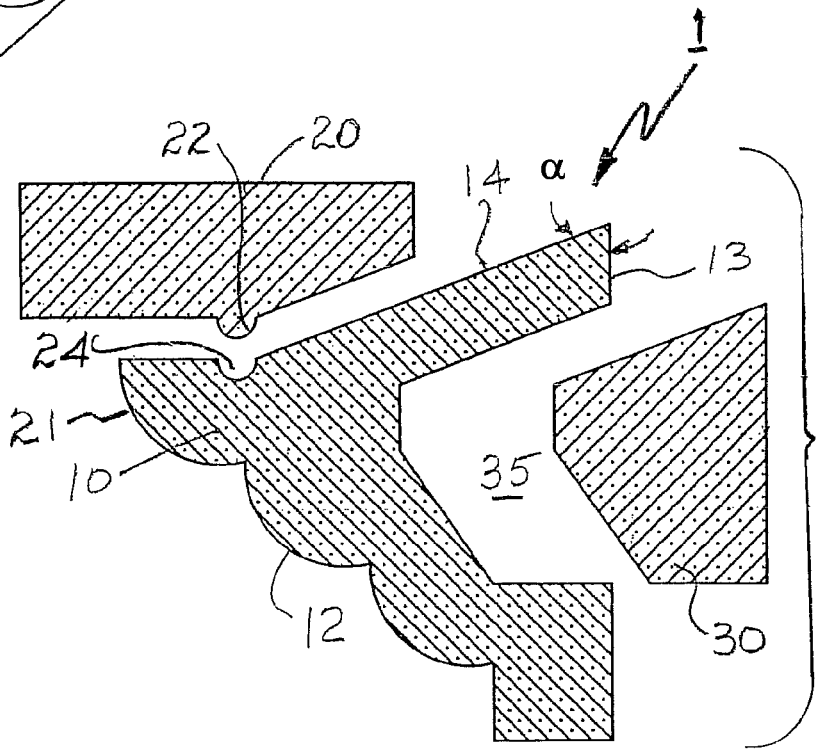
FIG. 2 is an exploded sectional side plan view of the molding runner assembly of FIG. 1 illustrating the engagement of the molding runner piece and an alignment wedge according to one embodiment of the present invention.

Referring to FIG. 2, molding runner piece 10 includes a forward decorative surface 12, a general rearward attachment surface 13, and an alignment surface 14 that abuts attachment surface 13. Attachment surface 13 is adapted to be fastened to a wall, as will be described. Attachment surface 13 and alignment surface 14 define an acute internal angle $\alpha$, as shown. When removable block 30 is removed from the back of molding runner piece 10, a channel 35 is defined relative to attachment surface 13. During installation, removable block 30 may optionally be removed under particular circumstances, as will be described thereby allowing ready adaptation to a particular geometry.

Figure 3A:
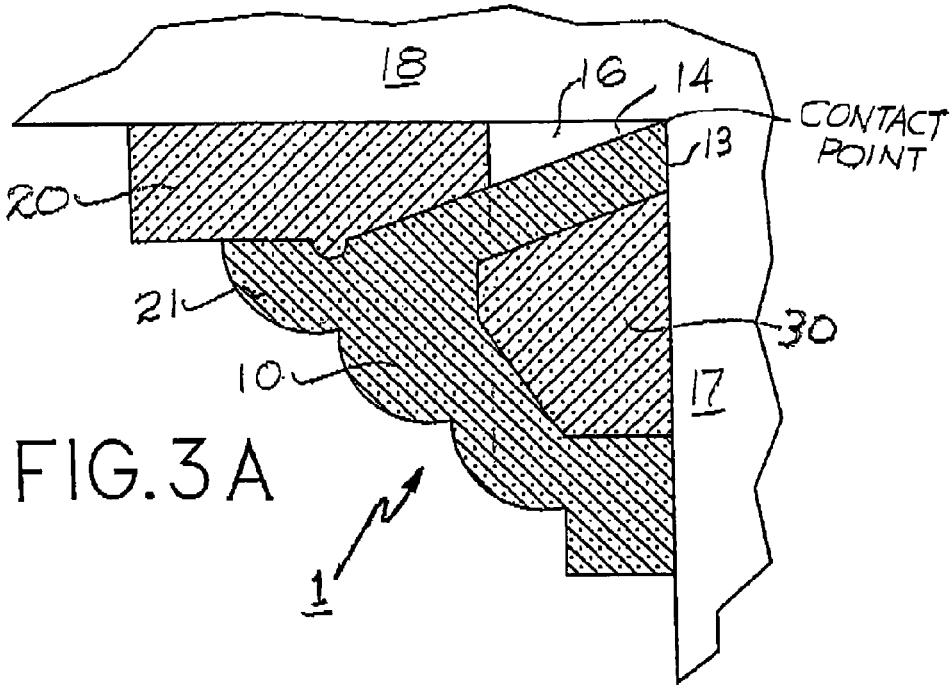
FIG. 3A is a sectional side plan view of the molding runner assembly of FIG. 1 installed at a ceiling-wall intersection using an alignment wedge to cover the alignment gap.
Figure 3B:
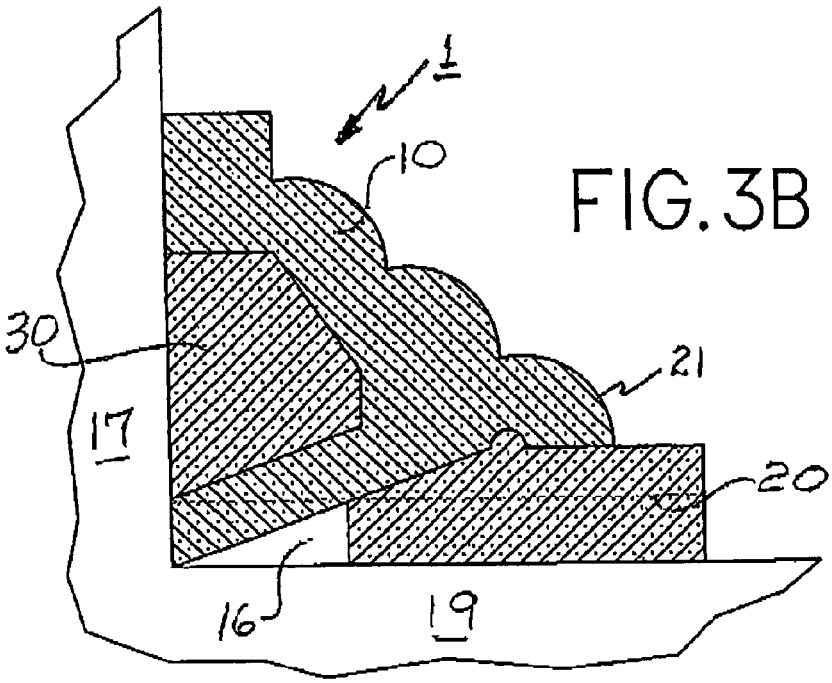
FIG. 3B is a side plan view of the present invention shown with molding runner assembly of FIG. 1 installed at a floor-wall intersection wherein the molding runner assembly comprises a compressible lip portion to cover the alignment gap. Of course, this orientation may be reversed positioning the alignment gap respectively.

Additionally referring now to FIGS. 3A and 3B, placing rearward attachment surface 13 against a wall 17 and placing alignment surface 14 adjacent to a ceiling 18 forms and defines an alignment gap 16 between alignment surface 13 and adjacent ceiling 18. Alignment gap 16 is adapted to be covered to thereby produce the appearance of a unitary corner molding piece that is mounted flush to both the wall and the adjacent ceiling, as will be described. Alignment gap 16 may be covered with a separate alignment wedge 20 or by a compressible lip portion (shown later) that similarly contacts ceiling 18.

Any suitable means may be used to attach molding runner piece 10 to wall 17. Suitable attachment means include, without limitation, adhesives and bonding agents (liquid, foam or tape based) or hook-and-loop (i.e., Velcro®). For example, molding runner piece 10 may additionally comprise an adhesive tape (shown later) disposed on attachment surface 13. The adhesive may be covered with a removable non-adhesive backing tape. During installation, a user would remove the non-adhesive backing tape and stick molding runner piece 10 to wall 17, so that film or tape surface stick to wall 17. As an additional example, a hook-and-loop system (shown later) may be used to attach molding corner piece 10 to wall 17. According to one embodiment, a useful hook-and-loop closure system may comprise a pair of complementary elements, wherein one element is affixed along a portion of attachment surface 13 and the other element is affixed along wall 17. A user would first align and join the complementary elements and then press-attach molding runner piece 10 to wall 17.

When used, alignment wedge 20 is adapted to cover the alignment gap 16 to thereby produce the appearance of a unitary molding piece that is mounted flush to both the wall and the adjacent ceiling. In one embodiment, alignment wedge 20 comprises a protuberance 22 adapted to mate with a detent 24 in alignment surface 14.

Protuberance 22 and detent 24 are located so that the externally visible portion of alignment wedge 20 completes and unifies the appearance molding runner assembly 1 relative to the wall-ceiling (17, 18) or wall-floor interface (17, 19). Moreover, by mating protuberance 22 with detent 24, alignment wedge 20 is at least temporarily securely held in the alignment gap, and depending upon the shape of protuberance/detent 22/24 wedge 20 may be permanently secured in this manner. Alternatively, wedge 20 is attached to the adjacent ceiling 18 using suitable means described above. Consequently, like molding runner piece 10, any suitable attachment means may be used to secure wedge 20 in position relative to ceiling 18, floor 19, or molding runner piece 10.

In an alternative embodiment, a compressible lip portion 21 is adjacent to or integrated with the edge portion of forward decorative surface 12, proximate alignment wedge 20. As shown in FIGS. 3A and 3B, lip portion 21 is in its compressed form after installation. Where present, and prior to installation, lip portion 21 may elastically extend from decorative surface 12 and may even extend above the top of attachment surface 13 so that; during installation and compression of compressible lip portion 21, alignment gap 16 can be covered even if the ceiling 18 (or adaptively floor 19) slopes away from a ninety-degree (90°) right-angle junction with wall 17. Alternatively, where ceiling 18 or floor 19 slopes inwardly (less than a right-angle junction) from its junction with wall 17, lip portion 21 can be additionally compressed inwardly to exactly conform to the slope of the ceiling 18 (or adaptively floor 19).

Referring again to FIG. 2, molding runner piece 10 preferably comprises a channel 35. The principal effect of channel 35 is reducing the weight of molding runner piece 10. Additionally, depending upon the material used to make molding runner piece 10, channel 35 may provide flexibility or compliance that allows a user to compress rearward attachment surface 13 or flex assembly 1 relative to non-linear installation position.

Optionally, channel 35 may be filled with a removable block 30. Removable block 30 may be formed from molding runner piece 10 when channel 35 is cut. Alternatively, removable block 30 may be formed by a separate method and subsequently inserted into channel 35, either in whole or in part along the linear length of assembly 1. Consequently, while it is preferable to separate removable block 30 (when present) from molding runner piece 10 before molding runner piece 10 is installed, it is possible to install molding runner piece 10 without separating removable block 30. Removable block 30 may be of any suitable shape and size. While many alternative embodiments are envisioned, FIGS. 1-2 depict an embodiment where removable block 30 is of a shape and a size to completely fill channel 35 and provide compressive support. Thus, the shape and size of removable block 30 may conveniently be dictated by the shape and size of channel 35 but is not necessarily so. For example, removable block 30 may be narrowed in the thickness direction to provide support to the two surfaces 13 but not contact the inner channel 35. As shown in the figures, the cross-sectional shape of removable block 30 is a five-sided polygon.

Those of skill in the art should recognize, that while removable block 30 is depicted in multiple embodiments nothing herein shall require the use of block 30. Block 30 is intended an alternative to support each block. In one preferred embodiment of each design, there is NO requirement to include a block 30. Thus, for example, the embodiments in 3A and 3B may be installed completely without any internal block 30 to allow for maximum flexibility and compressibility to adapt to irregular wall dimensions.

Figure 4A:
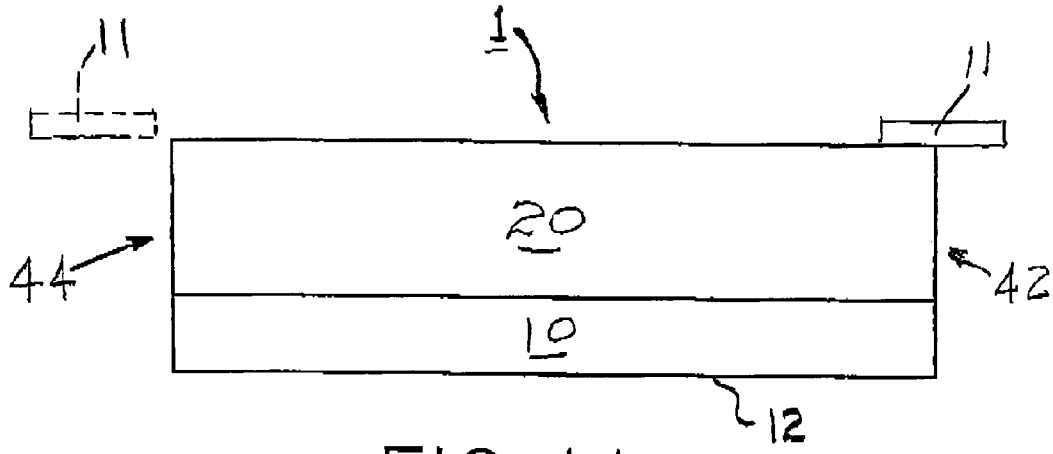
FIG. 4A is a top view of an alternative embodiment of the present invention employing the molding runner assembly of FIG. 1 comprising an optional integrated joint cover.

Additionally referring now to FIG. 4A, molding runner piece 10 may additionally comprise or include at least one joint cover segment 11 positioned along and projecting from an outer front surface of runner piece 10, proximate an unfinished end 44, as shown. Where cover segment 11 is affixed to or formed with runner piece 10, unfinished end 44 is alternatively referred to as and becomes a concealed end 42. While FIG. 4A depicts the installation of a single cover segment 11, alternative embodiments may exist where a joint cover segment 11 desirably projects from both ends of molding runner piece 10, thereby providing two concealed ends 42. Joint cover segment 11 may be formed integrally with runner piece 10, or later joined to runner piece 10 during installation and assembly, as will be described.

Figure 4B:
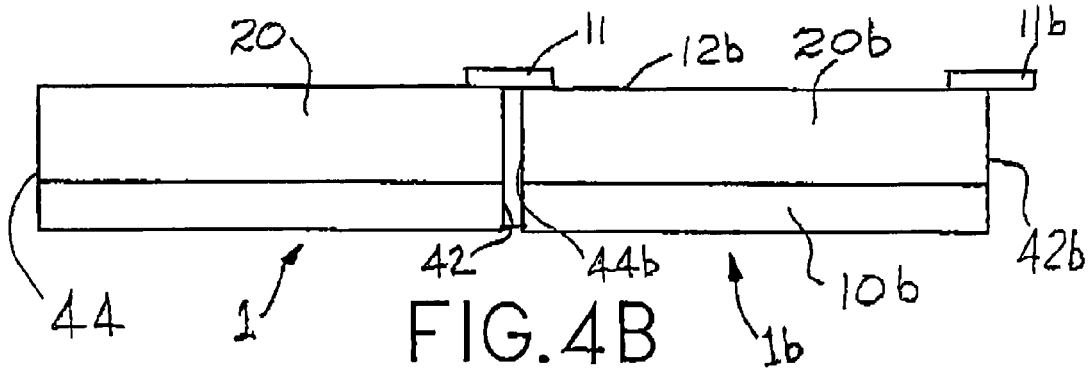
FIG. 4B is a top view of the molding runner assembly of FIG. 4A cooperating with a similar molding runner assembly.

Additionally referring now to FIG. 4B, during installation a second assembly 1*b* may be joined with first assembly 1. Second assembly 1*b*, is formed similarly to first assembly 1 and includes a runner piece 10*b*, an alignment wedge 20, a joint cover segment 11*b*, and unfinished and concealed ends 44*b*, 42*b*, as shown. During assembly, joint cover segment 11 of first assembly 1 slidably or telescopically receives unfinished end 44*b* of an adjacent molding runner piece 10*b* on an adjacent assembly 1*b* and preferably engages the decorative surface 12*b* thereof forming a seamless joint and concealing any gaps.

Figure 4C:
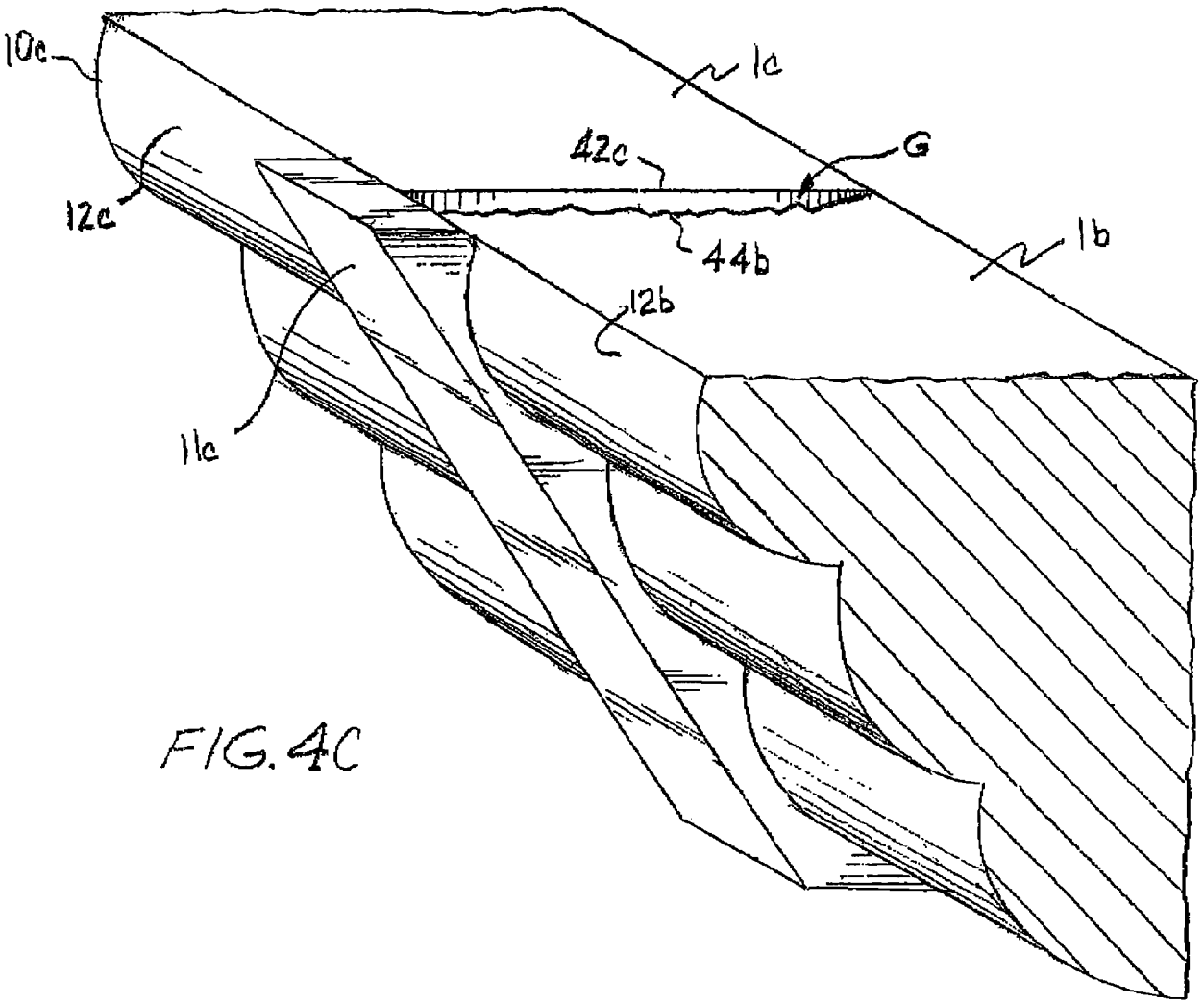
FIG. 4C is a side perspective view of an alternative embodiment of the present invention depicting a joint cover segment between a pair of adjacent molding assemblies.

In an alternative embodiment shown in FIG. 4C, a joint cover segment 11*c*, projects from a third assembly 1*c* proximate a concealed end 42*c*. Third assembly 1*c* includes a runner piece 10*c* with a decorative surface 12*c*. Joint cover segment 11*c* includes a reverse profile to that of decorative surface 12*b*. During assembly, second assembly 1*b* is cut to a desired length forming unfinished end 44*b* and joint cover segment 11*c* slides over and mates with decorative surface 12*b* concealing unfinished end 44*b* and any joint or gap G. Thus, the joining second and third assembly 1*b*, 1*c* permits unfinished end 44*b* to have a rough or approximate cut without affecting the finished appearance of the assembled modular molding system. In sum, when assembled, joint cover segments (11, 11*b*, 11*c* etc.) cooperate with wall 17 (not shown) and the adjacent surface (ceiling 18 or floor 19, both not shown) to totally enclose and conceal unfinished end 44*b*, which provides the exterior appearance of an accurate and precise joint even though unfinished end 44*b* may be rough cut. Preferably, joint cover segment 11 is fashioned as a repeating design element, such as a rosette block, plinth, or any other architectural feature that may be desired. It should be noted by those skilled in the e art, that joint cover segments 11, 11*b*, 11*c* may be fashioned with additionally compressive end portions (shown but not numbered) similar to compressive end 21. In this manner, the joint cover segments may be used with various designs and continuous or non-continuous alignment wedges. It is additionally envisioned, that joint cover segments may project away from runner piece 10 to conceal joints between sections of multiple alignment wedges. It is further envisioned, that a removable portion (not shown similar to channel element 30 shown in FIG. 2) is removed from 1*b* and 1*c* allowing maximum installation flexibility. As should be clear to those of skill in the art, the back portion of each molding section (elements 30, 130, etc.) may be removed for economy, installation, and speed.

Referring to FIG. 5, there is illustrated a molding corner assembly 100, for an alternative modular molding system according to the present invention. Molding corner assembly 100 includes at least a molding corner piece 110 having a corner cut away portion 300 enabling installation in non-perfect corners, an alignment wedge piece 120, and a removable block 130, as shown. As may be seen from the figure, the present invention easily provides adaptation to inside-corners (shown), and alternatively to outside-corners (not shown). Since alignment wedge piece 120 need not extend fully in the corner, yet fills the entire visual gap, there is no need to fill cut away portion 300. Employing this embodiment of the present invention a user may easily install a corner assembly 100 in a wall or ceiling corner and attach additional assemblies 1 (not shown) on either side to extend along the length of the wall to an opposite corner. While the embodiment shown forms a right angle (90°) those skilled in the art should readily understand that adaptations may be made for a variety of angles and curved surfaces. As a consequence, the present invention promotes rapid assembly and integration with a variety of complex room shapes and architectural designs. It should be additionally understood, that corner assembly 100, and it's obvious adaptations may further include one or more joint cover segments (not shown) serving similar purposes to the joint cover segments 11 noted in previous embodiments.

Additionally referring now to FIG. 6, molding corner piece 100, similar to the previous embodiments discussed, includes a forward decorative surface 112, a rearward attachment surface 113, and an alignment surface 114 that abuts attachment surface 113. Similar to attachment surface 13 noted in previous embodiments, attachment surface 113 is adapted to be fastened to a wall. Significantly, attachment surface 113 and alignment surface 114 define an acute internal angle β, as shown, although alternative joining angles are envisioned in the present invention.

Referring again to FIG. 6, molding corner piece 110 may alternatively or additionally include a channel 135 formed between the outer surface of removable block 130 and the inner surface of shaped corner piece 110. As shown, removable block 130 is fully positioned within channel 135, with a portion of corner piece cut away, but block 130 may be removed for additional flexibility as will be discussed. As earlier noted, one principal effect of channel 135 (forming separable block 130) is reducing the weight of molding corner piece 110. Additionally, depending upon the material used to make molding corner piece 110, channel 135 may afford additional flexibility or compliance that allows a user to compress or shape rearward attachment surface 113 and hence accommodate wall undulation or non-uniformity.

Optionally, channel 135 may be filled (in whole or part) with a removable block 130. Removable block 130 may be formed from molding corner piece 110 when channel 135 is cut. Those skilled in the art of plastic forming will recognize that removable block 130 may be formed either initially with runner piece 110, or by a separate method or in a separate step and subsequently inserted into channel 135 during assembly. While it is preferable to separate removable block 130 from molding corner piece 110 before molding corner piece 110 is installed, it is also to install molding corner piece 110 without separating removable block 130 there from.

As earlier noted, those skilled in the art should recognize that removable block 130 may be of any suitable shape and size suitable to effect the goals of the present invention. However, it is expected that the size and shape of removable block 130 will usually be dictated by the shape and size of channel 135. As shown in the figures, the cross-sectional shape of removable block 130 is, in the embodiment shown, a five-sided polygon. As is equally important to recognize, the embodiments discussed herein may be formed without any type of removable block (30/130) having only an open channel shape. Thus, those skilled in the art should clearly recognize that the present invention is not limited to the embodiments depicted in the figures but also includes the embodiments described by the words, namely those embodiments without a removable block and having a preformed open channel shape.

Figure 7A:
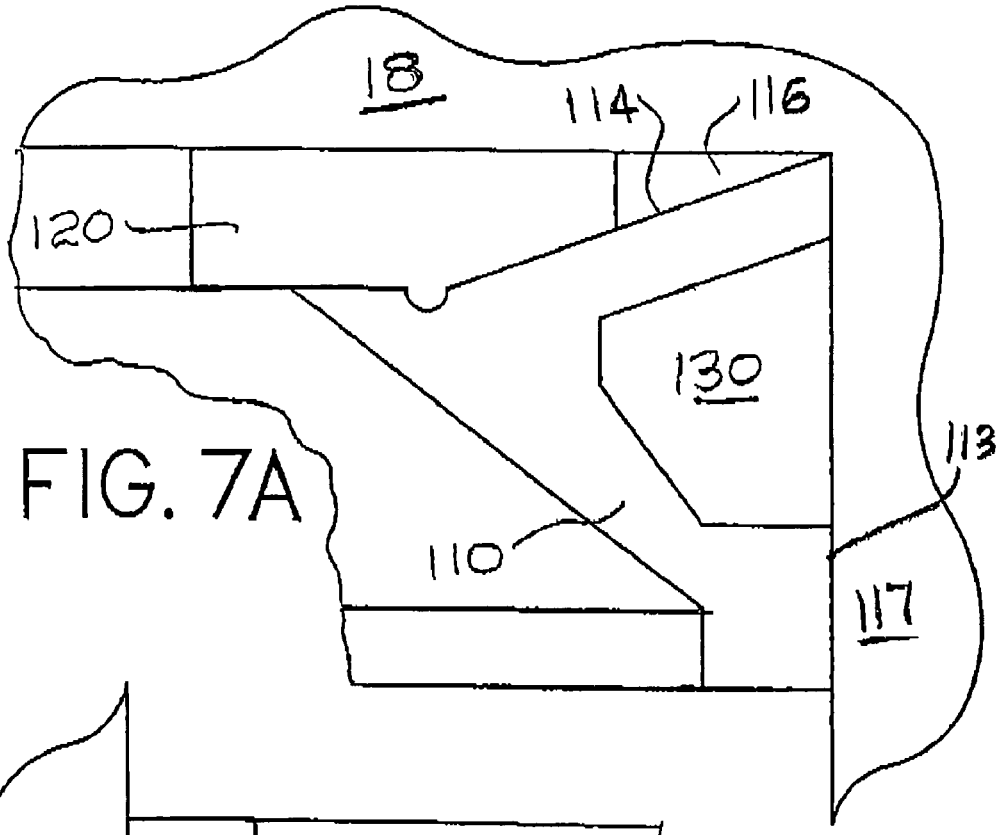
FIG. 7A is a partial-perspective side plan view of the molding corner assembly of FIG. 5, installed at a ceiling-wall intersection.
Figure 7B:
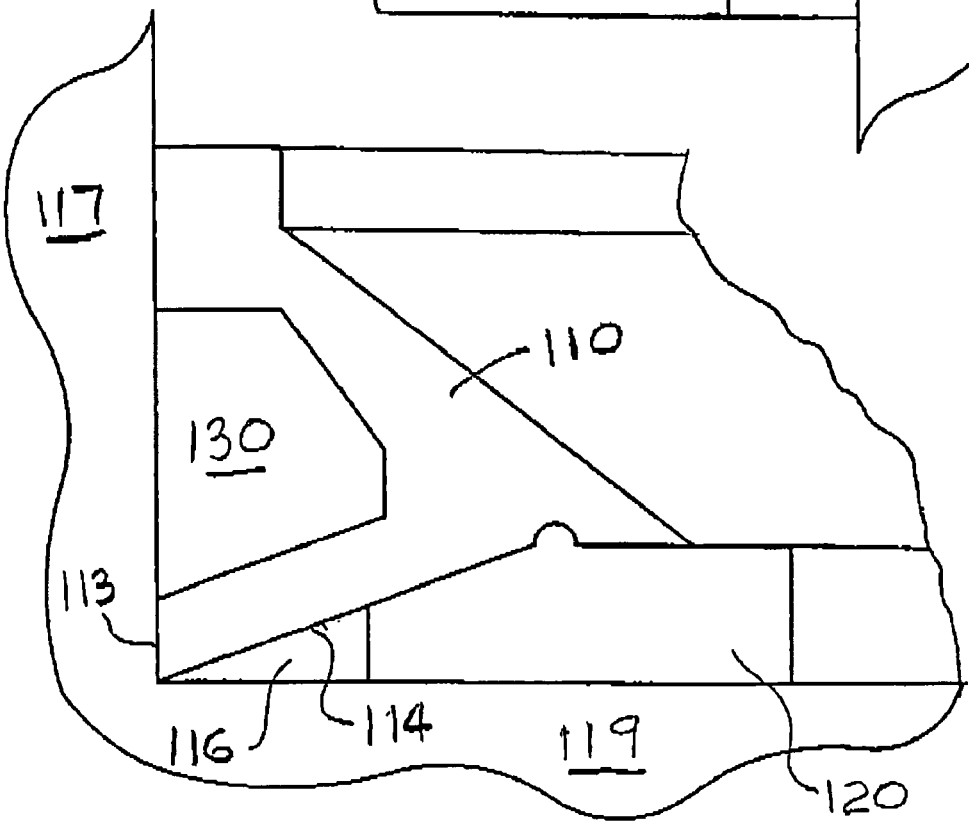
FIG. 7B is a partial-perspective side plan view of the molding corner assembly of FIG. 5, installed at an alternate wall-surface interface.

As shown in FIGS. 7A and 7B, perspective side views of alternative embodiments of the present invention position rearward attachment surfaces 113 against a wall 117 and place alignment surfaces 114 adjacent a respective ceiling 118 or a floor 119, forming respectively alignment gaps 116 there-between, as shown. Alignment gap 116 is adapted to be covered by alignment wedges 120 (as shown) to thereby produce the appearance of a unitary corner molding piece that is mounted flush to both the wall 117 and the adjacent ceiling 118 or floor 119. While it is preferable that alignment gap 116 is covered with alignment wedge 120. As noted earlier, a compressible lip portion (not shown) may be alternatively or additionally employed to cover alignment gap 116 (in a manner similar to the previously discussed compressible lip 21.

Any suitable means may be used to attach molding corner piece 110 to wall 117. Suitable attachment means include, without limitation, adhesive, or hook-and-loop (i.e., Velcro®). Preferably, molding corner piece 110 comprises an adhesive disposed on attachment surface 113. The adhesive may be covered with a removable non-adhesive tape. A user would remove the non-adhesive tape and stick molding corner piece 110 to wall 117, so that film or tape peel and stick. As an alternative, referring to FIGS. 12A and 12B, a hook-and-loop system may be used to attach molding corner piece 110 to wall 117. A useful hook-and-loop closure system would comprise a pair of complementary elements, such as hook strip 1201 and loop strip 1202, wherein one element is affixed to attachment surface 113 and the other element is affixed to wall 117. A user would align and join the complementary elements to attach molding corner piece 110 to wall 117.

Figure 8A:
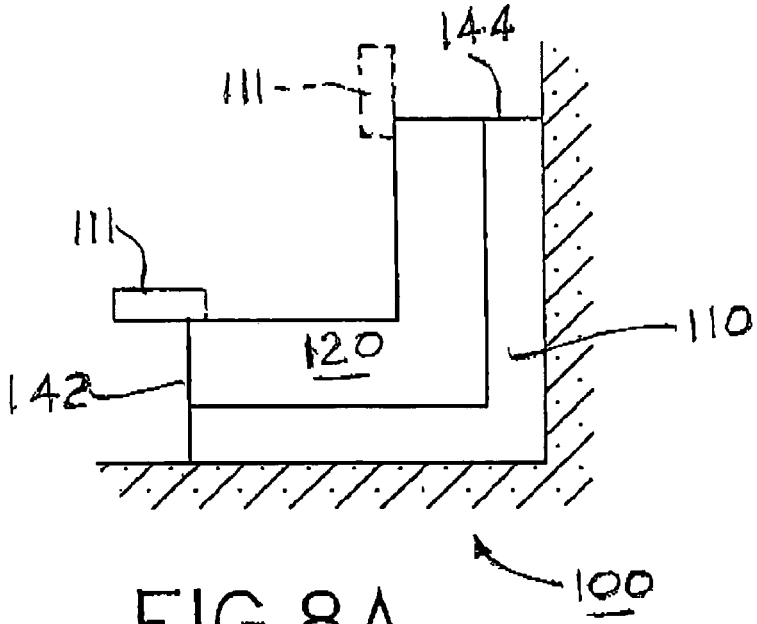
FIG. 8A is a top view of the molding corner assembly of FIG. 5 further comprising an optional integrated joint cover according to an alternative embodiment of the present invention.
Figure 8B:
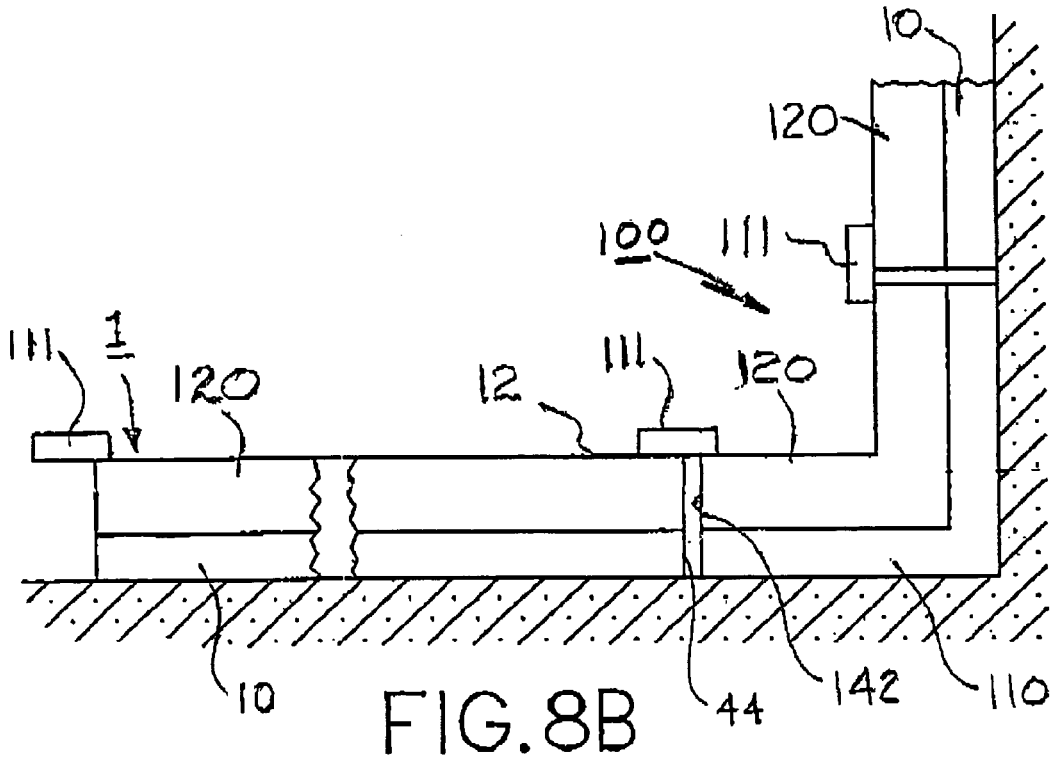
FIG. 8B is a top view of the molding corner assembly of FIG. 8A cooperating with a molding runner assembly, according to another alternative embodiment of the present invention.

Referring to FIGS. 8A and 8B, in one alternative embodiment, molding corner piece 110 includes a joint cover segment 111 extending from at least one side, which provides molding corner piece 110 with a concealed end 142 proximate the at least one joint cover segment 111, and an opposing unfinished end 144. Optionally, molding corner piece 110 may comprise a joint cover segment 111 at both ends, thereby providing two concealed ends 142. Joint cover segment 111 is adapted to slidably or telescopically receive the unfinished end 44 of an adjacent molding runner piece 1 and preferably engages the decorative surface 12 thereof. When assembled, joint cover segment 111 cooperates with wall 117 and the adjacent ceiling 118 or floor 119 to totally enclose and conceal unfinished end 44, which provides the exterior appearance of an accurate and precise joint even though unfinished end 44 may be rough cut.

Figure 9:
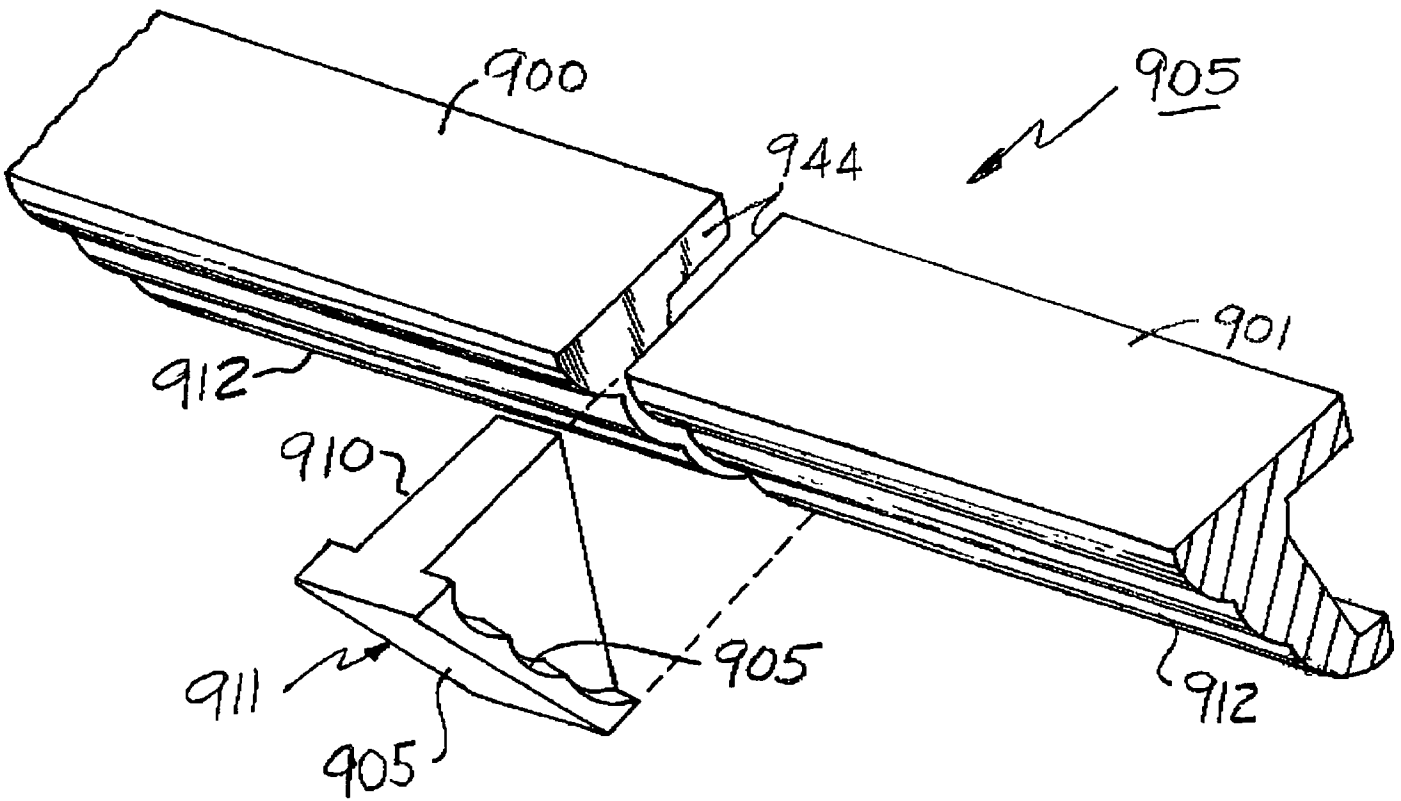
FIG. 9. is an exploded sectional view of an alternative embodiment of the present invention.

Referring to FIG. 9, there is shown an alternative embodiment of the present invention wherein a joint cover segment 911 includes a forward decorative face 905 and a rearward body 910. A matching face 905*a* is shaped to match with an outer surface 912 on each respective molding assemblies 900, 901, as shown. During assembly, body 910 is disposed between a pair of molding assemblies 900 and 901 and is formed to enable face 905*a* to smoothly match respective surfaces 910 and form a seamless gap. In an adaptation of the present embodiment, decorative face 905 may extend slightly below the bottom of respective outer surface 912 and cover any gap there-between.

Body 910 may be attached to molding assembly 900 and/or 901, and when installed may also be pre-attached to an adjacent ceiling and or wall, depending upon a user's preferred installation technique. Similar to previous joint cover segments 11 and 111, the function of joint cover segment 911 is to conceal the joint between molding assemblies 900 and 901, and their associated clean or rough cut edges 944, 944. However, joint cover segment 911 is not initially an integral part of either molding assembly 900 or 901. Instead, joint cover segment 911 is an independent piece and may be later assembled as needed by a user. The present embodiment enables an easy linear forming for assemblies 900, 901 and simplified packaging apart from joint cover segment 911. As a consequence of the present embodiment, an integrally formed separate joint cover segment cannot be inadvertently broken off of a molding assembly during shipping, handling, and installation, and losses are minimized.

Figures 10A, 10B:
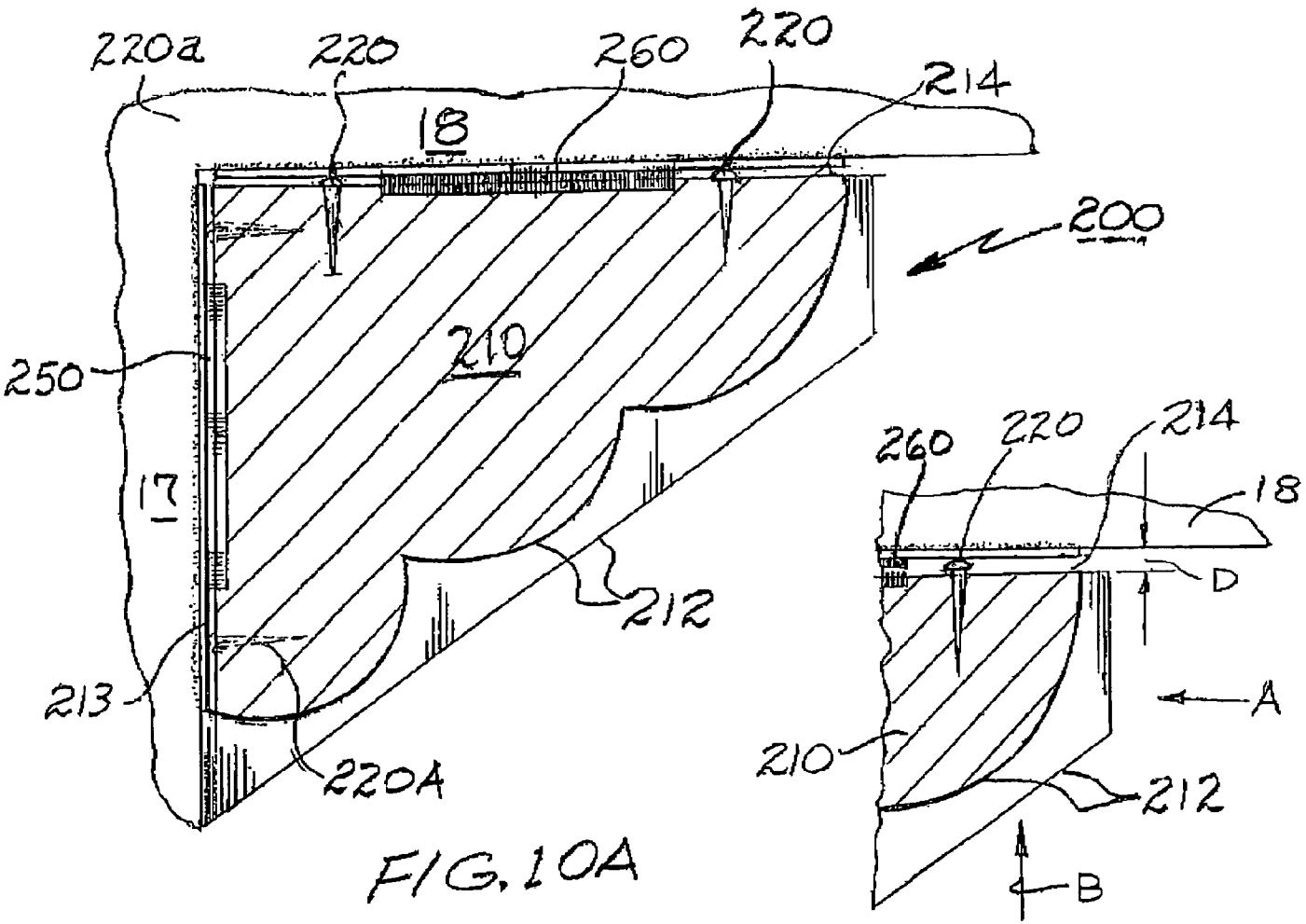
FIG. 10A is a partial sectional side view of another alternative embodiment of the present invention affixed to a wall/ceiling interface.
FIG. 10B is a detailed side view of a portion of the molding runner piece of FIG. 10A.

Referring to FIGS. 10A, 10B, there is shown a cross-sectional view of one alternative molding runner assembly 200, according to an alternative and adaptive embodiment of one aspect of the present invention, with similar reference being made to a related a molding runner assembly 300 as shown in later FIG. 11. With this alternative embodiment, and in particular, FIG. 10A shows molding runner assembly 200 including a molding runner piece 210, a plurality of placement guides 220, and selected attachment devices 250 and 260 (for example double stick foam tape or a Velcro®-type product. Molding runner piece 210 has a forward decorative surface 212, a rearward attachment surface 213, and a respective alignment surface 214. Attachment surface 213 is adapted to be fastened to a wall 17 by attachment device 250. Alignment surface 214 is adapted to be fastened to a ceiling 18 by attachment device 260, as will be described, and thereby be transformed into an attachment surface 214.

Placement guides 220 project outwardly from ceiling 18 and wall 17 and function to allow molding runner piece 210 to be freely moved and oriented during the installation thereof before being prematurely attached to wall 17 and ceiling 18. In sum, placement guides 220 function as a means to prevent the attachment devices 250 and 260 from prematurely coming into contact with wall 17 and ceiling 18 and corresponding portions of sections of attachment surfaces. Molding runner piece 210 is first disposed in its desired location at the cynosure between wall 17 and ceiling 18 through pressure applied in direction A, forming a minor gap D having a minor distance between ceiling 18 and alignment surface 214. Thereafter, upward pressure is applied in a direction B, on molding runner piece 210 for the purpose of attaching it to ceiling 18, resulting in respective placement guides 220 being displaced or pressed into molding runner piece 210, as illustrated by depressed placement guides 220A. Placement guides 220 may be any suitable shape, size, and material. Preferably, as shown, placement guides 220 are relatively small nail-shaped metallic or plastic rods, which are less flexible or compliant compared to molding runner piece 210.

In the present embodiment, molding runner piece 210 is preferably made of a partially compliant material, such as foam, so that placement guides 220 may be displaced or pressed into molding runner piece 210 (see depressed placement guides 220A) when upward pressure is exerted on molding runner piece 210 for the purpose of attaching it in the corner between wall 17 and ceiling 18, as shown. If molding runner piece 210 is made of a material that prevents placement guides 220 for being displaced or pressed into molding runner piece 210, then attachment devices 250 and 260 may be alternatively adapted to attach molding runner piece 210 to wall 17 and ceiling 18, respectively, despite the gaps there between caused by placement guides 220. For example, attachment devices 250 and 260 may be hook-and-loop closures, wherein the loop side comprises piles that are long enough to connect with the hook side.

Figure 11:
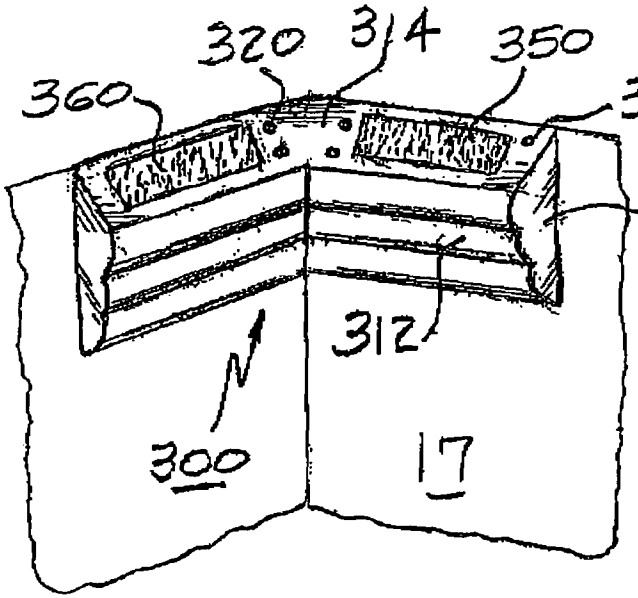
FIG. 11 is a perspective view of a molding corner piece according to one embodiment of the present invention, wherein the attaching means comprises a hook-and-loop type fastener.
Figure 13:
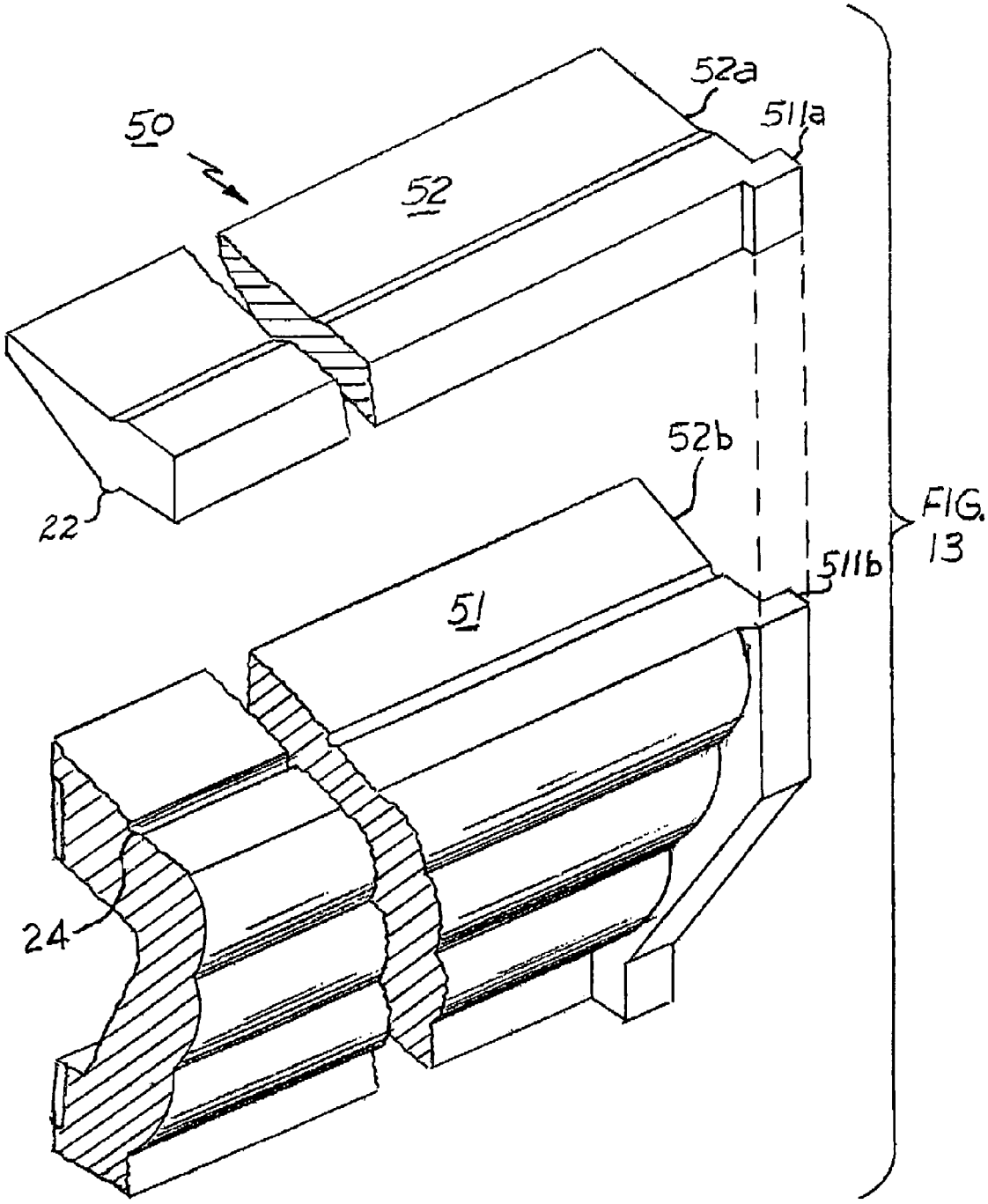
FIG. 13 is an exploded side-perspective view of one embodiment of the present invention including an upper compensating alignment wedge with a joint cover portion.

Referring now to FIG. 11, there is shown a front perspective view of a molding corner assembly 300 according to another embodiment of the present invention, that is also described herein above in reference to the molding runner assembly 200 of FIGS. 10A and 10B. In particular, FIG. 11 shows a molding corner piece assembly 300 comprising at least a molding corner piece 310, a plurality of placement guides 320, and respective attachment devices 350 and 360, which may be singular (shown) or continuous.

Molding runner piece 310 has a forward decorative surface 312, a rearward attachment surface (not shown), and an alignment surface 314. Alignment surface 314 is adapted to be fastened to a ceiling (not shown) by attachment devices 350 and 360. The rearward attachment surface is preferably adapted to be fastened to wall 17 by a suitable attachment device (discussed earlier). The method of using and making molding corner assembly 300 is substantially similar to the method of using and making molding runner assembly 200.

Installation of modular molding systems may be done by a consumer with little or no skill. In a preferred embodiment, the installation of modular molding systems in accordance with the present invention may be done without the use of nails, screws, or carpentry.

Figure 12A:
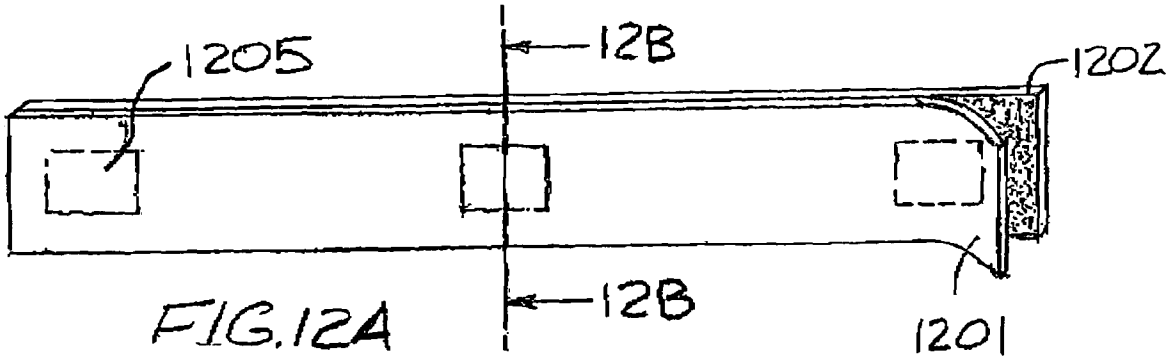
FIG. 12A shows an exemplary means for attaching a corner molding piece to a wall, wherein the attaching means comprises a hook-and-loop-type fastener tape.
Figure 12B:
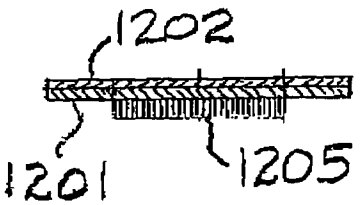
FIG. 12B is a detail view of the "hook" side of the hook-and-loop-type fastener tape taken along line 12B-12B in FIG. 12A.

In another preferred embodiment, the installation of modular molding systems in accordance with the present invention employ hook-and-loop attachments (that may be attached with staples or adhesive layers), such as the hook-and-loop tape strips of FIGS. 12A and 12B.

As shown, a hook-and-loop attachment for use in the present invention comprises a hook strip 1201 and a loop strip 1202. Hook strip 1201 comprises a plurality of individually removable hook portions 1205 disposed on a strip or tape strip 1201, allowing ready adaptability. Loop strip 1202 preferably comprises a contiguous loop surface. Preferably, hook strip 1201 is affixed to a molding piece or alignment wedge, and loop strip 1202 is affixed to a wall or ceiling. Alternatively, the hook strip 1201 or hook portions 1205 may be applied to the wall or ceiling, while the loop strip 1202 is applied to the molding piece or alignment wedge. By employing at least one contiguous hook and/or loop surface, the installer may move and orient the molding piece or alignment wedge while maintaining the ability to connect the hook strip to the loop strip.

Referring again to the previous embodiments, (FIGS. 1 to 4B for example), molding runner assembly 1 is installed by first joining attachment surface 13 of molding runner piece 10 to wall 17, such that alignment surface 14 is adjacent to the ceiling 18. The user should insure proper alignment of molding runner piece 10 and proper adhesion of attachment surface 13 to wall 17. A plurality of similar molding runner pieces could be attached together before the joining thereof to wall 17, or each molding runner piece may be attached individually.

Alternatively, as stated above, a suitable adhesive is preferably pre-applied to attachment surface 13 during the production of molding runner piece 10. By attaching molding runner piece 10 to wall 17 as described hereby, an alignment gap 16 is formed between alignment surface 14 and the adjacent ceiling. Alignment wedge 20 is inserted into the alignment gap so that protuberance 22 is fully received by detent 24. If alignment wedge 20 is too large for the alignment gap, it may be shaped and/or cut to fit. If alignment wedge 20 is too small for the alignment gap, it may be expanded to fit or a suitable caulking material may be used to fill the space remaining after alignment wedge 20 is inserted into the alignment gap. A second molding runner piece 10*b* is installed next to molding runner piece 10 using the same method described hereby, with the additional step of inserting unfinished end 44*b* of molding runner piece 10*b* under joint cover section 11 of molding runner piece 10 such that unfinished end 44*b* is completely covered by joint cover section 11 and unfinished end 44*b* is in proximity to concealed end 42. The assembly of the modular molding system is completed by installing a plurality of molding runner assemblies and, where appropriate, molding corner assemblies.

Additionally referring now to FIGS. 13, 14A, 14B, and 14C, an alternative embodiment of the present invention includes a molding assembly 50 having a runner piece 51 and an alignment wedge 52. A cover portion 511*a* projects from a concealed side 52*a* of alignment wedge 52. A cover portion 511*b* projects from a concealed side 52*b* of runner piece 51. As earlier described, a protuberance 22 on alignment wedge 52 mates with detent 24 during installation. An attachment device 55 (for example peel & stick tape or other means) is formed flush with the back surface of runner piece 51 for suitable attachment to a wall as earlier described. The present embodiment notes the ready adaptability of the present invention and provides for simplified joint-concealment between individual alignment wedge pieces 52 and runner pieces, via an overlapping and matching of the mating finished profile in a manner similar to those previously discussed.

As shown, the present embodiment includes attachment device 55 positioned along the rear face of runner piece 51. Attachment device 55 may be continuous or sectional in nature. Attachment device 55 is spaced inwardly a first fixed distance from the top and bottom surfaces of runner piece 51, as shown. During assembly, attachment device 55 includes a backing/sticking member 17*a*, 17*b* affixed to the wall either in sectional patches (17*b* in FIG. 14B) or in continuous strips (17*a* in FIG. 14C). In each case, backing/sticking members

17*a*, 17*b* are positioned a second fixed distance X (as shown) from the ceiling and the predicted bottom of runner piece 51. As noted above, attachment device 55 may be any suitable attachment means including double-stick tape, double-stick foam tape, adhesive strips, hook-loop fasteners, and magnetic sections. In one of several preferable embodiment attachment device 55 is double-stick foam tape.

Figure 14A:
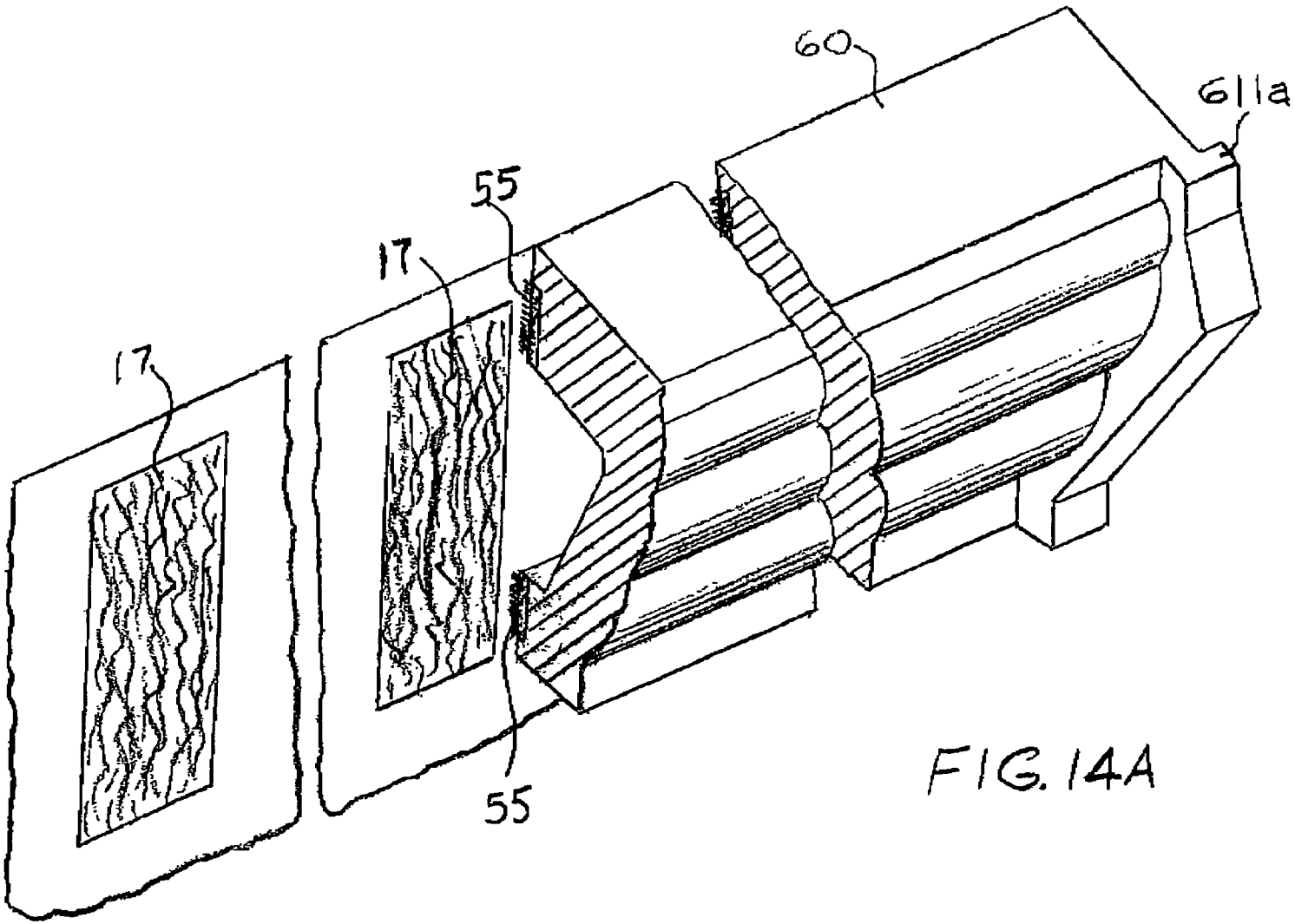
FIG. 14A is a side perspective view of one embodiment of the present invention shown affixed to a wall surface with a fastener system.
Figures 14B, 14C, 15:
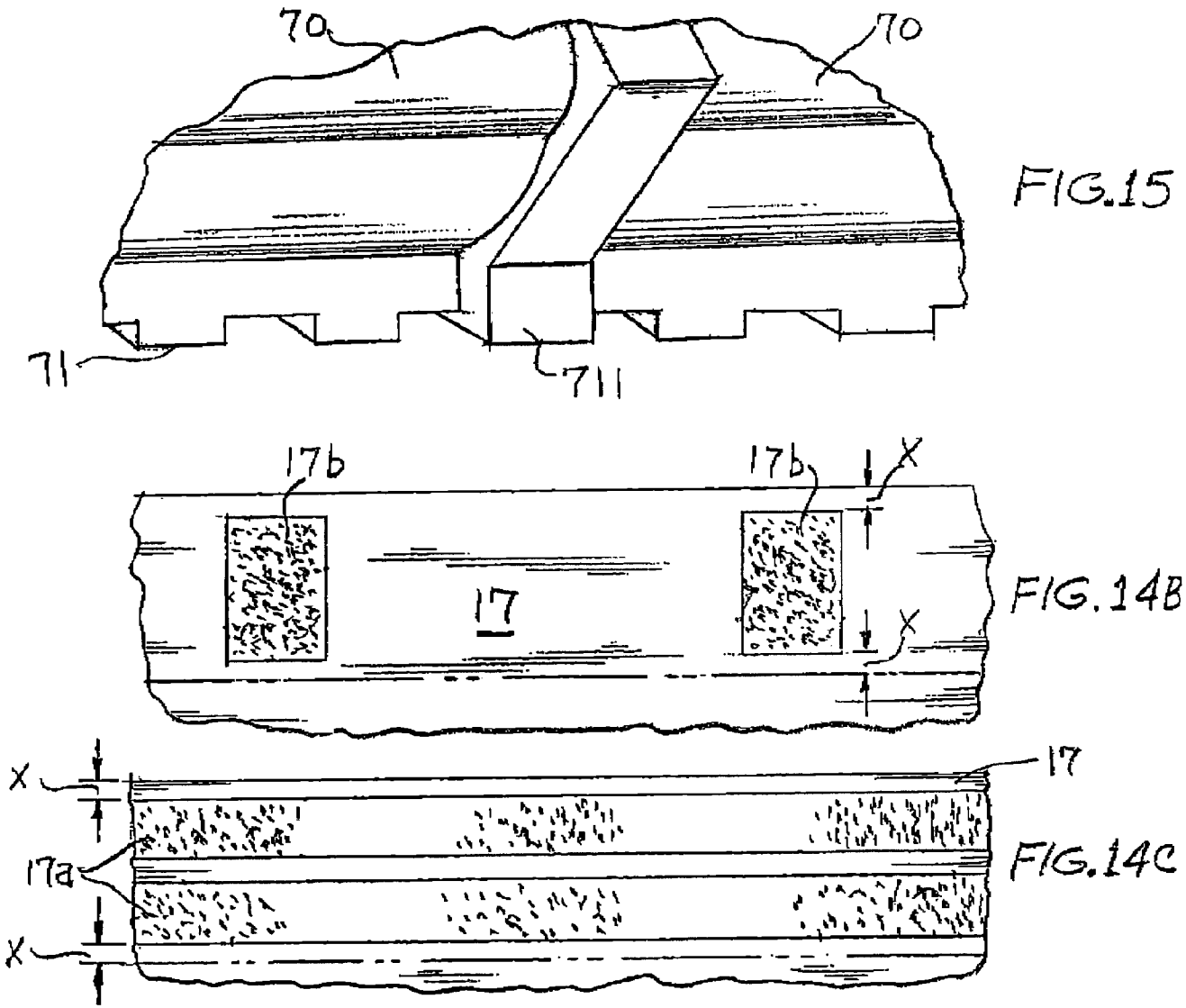
FIG. 14B is a side view of one aspect of the present invention, showing one of the fastening systems positioned relative to the wall-ceiling interface and the fastening system spaced along the wall.
FIG. 14C is a side view of another aspect of the present invention, showing another of the fastening systems positioned relative to the wall-ceiling interface wherein the fastening system is continuous along the wall.
FIG. 15 is a partial perspective view of one embodiment of the present invention including a bottom level detail, dentil molding shown.

One practical example of the embodiment shown in FIGS. 14A, 14B, and 14C would be where runner piece 60 has a total height of Y+X+X, where X is the fixed distances, and Y is the distance between the outer edges of attachment device strips. For example, Y may be 3.5 inches, and X may be 0.25 inches, so that the total height of runner piece 60 would be 3.5"+0.25"+0.25"=4.00." With this example it is easy to see several particular benefits of the present embodiment. First, using hook-loop attachment means 55, should the installer initially misalign runner 60 (within +/−0.5"), the installer may simply remove and reposition runner 60 relative to a level line or other marking. Second, should undulations in the ceiling require runner piece 60 to be spaced from the ceiling, the installer can simply attach runner piece 60 at a level needed without having to reattach backing/sticking members 17*a*, 17*b*.

In sum, it is believed that those skilled in the art should now readily appreciate the wide variability and adaptability possible with the present invention. In sum, the present invention provides for rapid and inexpensive installation of architecturally superior forms by non-skilled or low-skilled users.

Referring now to FIG. 15, an alternative embodiment of the present invention includes runner pieces 70, 70, with one runner piece 70 including a joint cover 711. A bottom edge detail 71 is formed on respective runner pieces 70, 70. As shown, bottom edge detail 71 is formed as dentil molding, but any suitable type of decorative detail may be used. In this embodiment, joint cover 711 extends along a wall (not shown) and is effective to receive both the front finished surface of the adjacent runner piece 70 and the adjacent edge detail 71. In this manner, the present invention enables both front and bottom edge detail use and ready adaptation to a variety of installation methods. A variation of the present invention provides lower edge detail 71 with a compressible feature similar to that provided by compressible edge 21. Employing a compressible lower edge detail 71 allows runner pieces 70 to adapt to varying wall surface conditions.

An additional benefit of the present invention is that is readily employed with a wide range of wall coverings, from simple and smooth paint, to wall paper, to rough plaster, concrete, and stucco types of wall surfaces. The present invention also allows for the ready removal of the molding without damaging the underlying wall coverings and does not require particularly destructive installation techniques commonly used with concrete walls and ceilings. Where a user employs hook-loop type attachment means, the runner piece may span undulations in the wall plane and any remaining gaps may be filled with conventional silicon calk. In sum, the present invention envisions ready adaptability to multiple wall/ceiling types and a variety of installation techniques, without causing prohibitive and costly damage.

A further benefit is that the present does not require the installer to fix the attachment means directly to the wall studs, although this is possible or even desirable where particularly heavy molding is used. The present system envisions a distribution of the attachment force along the general (but not necessarily continuous) breadth of the wall surface.

A further benefit of the present invention is that it enables convenient painting of either an assembled run of molding, or individual pieces prior to installation and attachment to a wall. Since individual pieces are matched together in a manner that readily conceals rough-cut ends, an installer may test fit the molding assembly and then remove it for separate painting and reinstallation. Alternatively, an installer may paint all the molding pieces pre-installation, and then cut them to fit after the painting step. Consequently, the present invention envisions ready adaptation to multiple finishing techniques and schedules.

Those skilled in the art should readily recognize that the method of installing molding corner assemblies is substantially similar to the method of installing molding runner assemblies.

Molding pieces according to the present invention may be made of any suitable material, such as polyurethane (PU), expanded polystyrene (EPS), and expanded polyvinyl chloride (EPVC). Preferred materials are suitably durable, flexible, moisture resistant, flame resistant, mildew resistant, and shrink resistant. Preferably, runner pieces are made from a slightly higher density polyurethane foam. In comparison to the runner pieces, alignment wedges according to the present invention may be preferably made from slightly lower density polyurethane foam, thereby enabling a user to slightly compress the alignment wedges during installation to secure a tight fit. While density differences are discussed, they are not mandatory and it is envisioned that each element in the above invention may be made from similar density materials where compressive needs are limited.

PU foam for use in one embodiment of the present invention will preferably have an overall density from about 14 pounds per cubic foot (lbs./ft$^2$) to about 24 lbs./ft$^2$, which is similar to White Pine, a common molding material. PU foam for use in the present invention may also preferably have a compressive strength between 300 and 400 pounds per square inch (psi), and a tensile strength between 350 and 400 psi. In one preferred method, a molding piece and alignment wedge may be formed together as a single, elongated piece, and then separated by cutting. In another preferred method, molding pieces and alignment wedges may be extruded through separate molds. The foam core may be covered with one or more coating materials, such as melamine, paint, gypsum, flame-resistant coating, anti-UV coating, or any other suitable coating material. In one preferred embodiment of the present invention, the foam core is covered with a melamine layer. The melamine coating is easy to paint, retains paint well, and is preferably colored white during manufacture. A molding piece and alignment wedge should preferably be manufactured to close tolerances because the cumulative effect of relatively small inaccuracies will lead to a visibly non-uniform finish despite a viewers distance from a wall/ceiling corner. Preferably, a molding runner piece or molding corner piece according to the present invention is about 3 feet (about 1 meter) from end to end.

A modular molding system according to the present invention provides many advantages. The individual pieces of the system can be easily cut and/or shaped without use of specialized equipment and techniques. In fact, in a preferred embodiment, the individual pieces may be cut with a kitchen knife. Misaligned pieces and rough-cut ends may be easily concealed or covered. Moreover, variations in walling and ceiling construction, which would otherwise make installation difficult, can be conformed to a visual uniformity. As noted above, a consumer with little or no skill can fit and install the modular molding system of the present invention.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A modular molding system, comprising:

at least a first molding piece;

said first molding piece including at least a forward decorative surface, a rearward attachment surface, and an alignment surface intersecting said attachment surface;

said attachment surface and said alignment surface defining an acute internal angle $\alpha$ therebetween and a molding edge where said alignment and attachment surfaces intersect, whereby placing said molding edge along a structural edge formed by first and second structural surfaces of a structure that define an internal angle greater than $\alpha$ allows alignment of said molding and structural edges prior to abutment of said attachment surface to one of said two structural surfaces and creates an alignment gap between said other one of said two structural surfaces and said alignment surface; and said alignment gap being dimensioned to be filled by at least one alignment wedge piece, whereby an outer surface of said at least one alignment wedge piece and said forward decorative surface provides an appearance of a unitary molding piece extending between said first and second structural surfaces.

2. The modular molding system, according to claim 1, wherein:

at least one of said first molding piece and said alignment wedge piece is made of a thermoplastic foam capable of elastic movement.

3. The modular molding system, according to claim 1, wherein:

at least one of said first molding piece and said alignment wedge piece is formed of a material other than wood.

4. The modular molding system, according to claim 1, wherein:

said rearward attachment surface further comprises at least an adhesive portion enabling a user to adhere said first molding piece to said first structural surface, whereby said module molding system can be easily and conveniently assembled and installed by a user.

5. The modular molding system, according to claim 1, wherein:

said alignment wedge piece is formed of a resilient compressible material; and said alignment gap is compressably filled and covered by said alignment wedge;

means for engaging said alignment wedge and said first molding piece when said alignment wedge covers said alignment gap; and said alignment wedge compressably spans said alignment gap thereby adapting to surface variations on each said structural surface and providing said appearance of a unitary molding piece extending between said first and second structural surfaces.

6. The modular molding system, according to claim 5, wherein:

said means for engaging includes at least a first and a second mating element;

said alignment surface of said first molding piece includes said first mating element, and said alignment wedge includes said second mating element, whereby said first mating element engages said second mating element during an assembly of said molding system and inhibits an unintended separation.

7. The modular molding system, according to claim 6, wherein:

said first mating element is a detent, and said second mating element is a corresponding protuberance, whereby said detent engages said protuberance during said assembly and inhibits said unintended separation.

8. The modular molding system, according to claim 1, wherein:

said alignment gap is compressibly filled and covered by a compressible lip portion adapted to cover said alignment gap.

9. The modular molding system, according to claim 8, wherein:

said compressible lip portion is adjacent to and generally projects from an uppermost portion of said forward decorative surface, whereby said lip portion compressably spans said alignment gap thereby adapting to surface variations on said structural surfaces and providing said appearance of a unitary molding piece extending between said first and second structural surfaces.

10. The modular molding system, according to claim 1, wherein:

said rearward attachment surface further comprises a flexibility channel portion.

11. The modular molding system, according to claim 1, wherein:

said first molding piece and said molding system is adapted for installation as a runner between two opposing corners joining said first and second structural surfaces.

12. The modular molding system, according to claim 1, wherein:

said first molding piece and said molding system is adapted for installation in at least one of an inward and an outward corner formed between said first, second, and a third structural surface external plane.

13. A modular molding kit comprising:

at least a first molding piece;

said first molding piece including at least a forward decorative surface, a rearward attachment surface, and an alignment surface intersecting said attachment surface;

said attachment surface and said alignment surface defining an acute internal angle therebetween and a molding edge where said alignment and attachment surfaces intersect, whereby placing said molding edge along a structural edge formed by first and second structural surfaces of a structure that define an internal angle greater than allows alignment of said molding and structural edges prior to abutment of said attachment surface to one of said two structural surfaces and defines an alignment gap between said first and second structural surfaces and said alignment surface; and a separable alignment wedge piece dimensioned to selectively fill said alignment gap and produce an outwardly appearance of a unitary molding piece extending continuously between said first and second structural surfaces.

14. The modular molding kit, according to claim 13, wherein:

said forward decorative surface, said rearward attachment surface, said alignment surface, and said molding wedge are made of a thermoplastic foam.

15. The modular molding kit, according to claim 13, wherein:

said first molding piece is formed of a material other than wood; and said alignment wedge piece is formed of a material other than wood.

16. The modular molding kit, according to claim 13, wherein:

said rearward attachment surface further comprises a means for securing said rearward attachment surface and said first molding piece to said first structural surface.

17. The modular molding kit, according to claim 13, wherein:

said alignment wedge piece further comprises a means for securing said alignment wedge piece to said second structural surface.

18. The modular molding kit, according to claim 13, wherein:

said alignment wedge piece comprises a means for securing said alignment wedge piece to said alignment surface of said first molding piece.

19. The modular molding kit, according to claim 12, wherein:

said alignment side of said molding piece further comprises a first mating element; and said alignment wedge further comprises a second mating element corresponding with said first mating element, whereby during an assembly of said module molding system said alignment wedge is positionably engaged within said alignment gap when said first and second mating elements are engaged.

20. The modular molding kit, according to claim 19, wherein:

said first mating element is a detent, and said second mating element is a corresponding protuberance, said protuberance engaging said detent during said assembly and prohibiting an unintended separation therebetween.

21. The modular molding kit, according to claim 13, wherein:

said rearward attachment surface further comprises a pair of opposing edges and a flexibility channel extending therebetween, whereby an operable flexibility of said first molding piece is increased.

22. The modular molding kit, according to claim 13, wherein:

said molding piece further comprises an integrated covering segment conjoined to an edge of said forward decorative surface on said first molding piece; and said covering segment being adapted to cover a seam between said forward decorative surface on said first molding piece and a second forward decorative edge on a second molding piece mounted adjacent to said first molding piece.

23. The modular molding kit, according to claim 13, wherein:

said first molding piece and said modular molding kit is adapted for installation as a runner between two opposing corners joining said first and second structural surfaces.

24. The modular molding kit, according to claim 13, wherein:

said first molding piece and said modular molding kit is adapted for installation in a corner formed between said first, second, and a third structural surface.

25. A modular molding assembly, comprising:

at least a first molding piece;

said first molding piece including at least a forward decorative surface, a rearward attachment surface and an alignment surface intersecting said attachment surface;

said attachment surface and said alignment surface defining an acute internal angle $\alpha$ therebetween and a molding edge where said alignment and attachment surfaces intersect, whereby placing said molding edge along a structural edge formed by first and second structural surfaces of a structure defining an internal angle greater than $\alpha$ allows alignment of said molding and structural edges prior to abutment of said attachment surface to one of said two structural surfaces and creates an alignment gap between said second structural surface and said alignment surface; and compressible alignment wedge piece dimensioned to selectively fill and cover said alignment gap during assembly of said modular molding assembly and produce an outward appearance of a unitary molding piece extending continuously between said first and second structural surfaces;

at least one integrated covering segment projecting from and conjoined to a side edge of said forward decorative surface; and said integrated covering segment being adapted to cover a seam formed between said first forward decorative surface on said first molding piece and a second forward decorative surface on a second molding piece mounted adjacent to said forward decorative surface.

26. The modular molding assembly, according to claim 25, wherein:

at least one of said first molding piece and said alignment wedge piece and said molding wedge, and said integrated covering segment are made of a thermoplastic foam.

27. The modular molding assembly, according to claim 25, wherein:

at least one of said first molding piece and said alignment wedge piece, and said at least one integrated covering segment is formed of a material other than wood.

28. The modular molding assembly, according to claim 25, wherein:

said rearward attachment surface further comprises a means for fixably positioning said at least first molding piece along at least said first structural surface; and said means for fixably positioning includes at least one of an adhesive compound, a velcro-type fastener means, and a plurality of threadable positioning members for adhering said rearward attachment surface to said one of said first and second structural surfaces.

29. The modular molding assembly, according to claim 25, wherein:

said alignment wedge piece further comprises at least one means for adhering said alignment wedge to said adjacent structural surface.

30. The modular molding assembly, according to claim 25, wherein:

said alignment wedge piece further comprises at least an adhesive compound for adhering said alignment wedge piece to said alignment surface of said at least first molding piece thereby preventing an unintentional separation therebetween.

31. The modular molding assembly, according to claim 25, wherein:

said alignment side of said at least first molding piece further comprising at least a first mating element, and said alignment wedge piece further comprising at least a second mating element corresponding with said first mating element, whereby said first and second mating elements engage during said assembly and prohibit an unintended separation between said first molding piece and said alignment wedge piece.

32. The modular molding assembly, according to claim 31, wherein:

said first mating element is a detent, and said second mating element is a corresponding protuberance.

33. The modular molding assembly, according to claim 25, wherein:

said rearward attachment surface of said first molding member further comprises a flexibility channel extending between a pair of side edges, whereby said molding assembly enables a flexibility effective to overcome planar variations along said first and second external structural surfaces and provide a pleasing outward appearance to an observer.

34. The modular molding assembly, according to claim 25, wherein:

said first molding piece and said modular molding assembly is adapted for installation in a corner formed between said first, second, and a third structural surface.

35. The modular molding assembly, according to claim 26, wherein:

said first molding piece and said modular molding assembly is adapted for installation as a runner between two opposing corners joining said first and second structural surfaces.

36. The modular molding system as defined in claim 1, comprising, in combination, said first and second structural surfaces.

37. A method of mounting a molding along a structural edge defined by first and second structural surfaces that intersect to define a predetermined internal angle and structural edge, wherein the molding includes at least a first molding piece that includes at least a forward decorative surface, a rearward attachment surface, and an alignment surface that intersects said attachment surface;

said attachment surface and said alignment surface defining an acute internal angle $\alpha$ therebetween and a molding edge where said alignment and attachment surfaces intersect, whereby placing said molding edge along a structural edge formed by first and second structural surfaces of a structure that define an internal angle greater than $\alpha$ allows alignment of said molding and structural edges prior to abutment of said attachment surface to one of said two structural surfaces and creates an alignment gap between said other one of said two structural surfaces and said alignment surface; and said alignment gap being dimensioned to be filled by at least one alignment wedge piece;

the method comprising the steps of aligning said molding edge with said structural edge and moving said molding to provide contact between said molding and structural edges while avoiding contact of at least said attachment surface with said structural surfaces;

while maintaining alignment and contact between said molding and structural edges moving said attachment surface into abutment or contact with said first structural surface to create an alignment gap between said alignment and second structural surfaces; and filling said alignment gap with an alignment wedge piece, whereby an outer surface of said at least one alignment wedge piece and said forward decorative surface provides an appearance of a unitary molding piece extending between said first and second structural surfaces.

38. The modular molding system as defined in claim 1, wherein said alignment wedge piece is formed of a compressible material.

39. A modular molding system as defined in claim 1, wherein said first molding piece includes a flexible projecting lip portion.

* * * * *